US007675018B2

(12) United States Patent
Jang et al.

(10) Patent No.: US 7,675,018 B2
(45) Date of Patent: Mar. 9, 2010

(54) CIRCUIT AND METHOD FOR DRIVING ORGANIC LIGHT EMITTING DIODE

(75) Inventors: Jin Jang, #302-908, Hanshin (7th) Apt., Jamwon-dong, Seocho-gu, Seoul 137-796 (KR); Joon-Chul Goh, Seoul (KR)

(73) Assignee: Jin Jang, Seoul (KR)

( * ) Notice: Subject to any disclaimer, the term of this patent is extended or adjusted under 35 U.S.C. 154(b) by 527 days.

(21) Appl. No.: 11/662,605

(22) PCT Filed: Sep. 15, 2004

(86) PCT No.: PCT/KR2004/002348

§ 371 (c)(1),
(2), (4) Date: Mar. 13, 2007

(87) PCT Pub. No.: WO2006/030994

PCT Pub. Date: Mar. 23, 2006

(65) Prior Publication Data

US 2009/0021287 A1 Jan. 22, 2009

(51) Int. Cl.
*H01J 40/14* (2006.01)

(52) U.S. Cl. ..... 250/214 R; 250/208.1

(58) Field of Classification Search ..... 250/214 R, 250/208.1, 234, 214.1; 348/302–308; 345/76–83
See application file for complete search history.

(56) References Cited

U.S. PATENT DOCUMENTS 6,774,577 B2 8/2004 Choi ..... 315/169.3
6,858,991 B2 * 2/2005 Miyazawa ..... 315/169.3

FOREIGN PATENT DOCUMENTS

JP 2003-005710 1/2003
JP 2004-029791 1/2004

OTHER PUBLICATIONS

International Search Report dated Jun. 14, 2005.

* cited by examiner

*Primary Examiner*—Que T Le
(74) *Attorney, Agent, or Firm*—Ked & Associates, LLP

(57) ABSTRACT

A drive circuit for organic light emitting diodes (OLEDs), and a method for driving OLEDs, using the drive circuit. The drive circuit includes pixel circuits, each of which includes a first transistor for receiving a data voltage, and outputting a drive current to an OLED, a second transistor for transmitting the data voltage to the first transistor, a third transistor for connecting the gate and drain of the first transistor, a capacitor for storing a gate voltage of the first transistor, and a fourth transistor connected to the drain of the first transistor. The OLED is connected to the source of the first transistor by a fifth transistor, or is directly connected to the source of the first transistor without using the fifth transistor. The drive circuit generates drive current, based on a non-uniformity-compensated threshold voltage of the first transistor, thereby obtaining a uniform luminance of the OLED.

18 Claims, 9 Drawing Sheets

[Fig. 1]
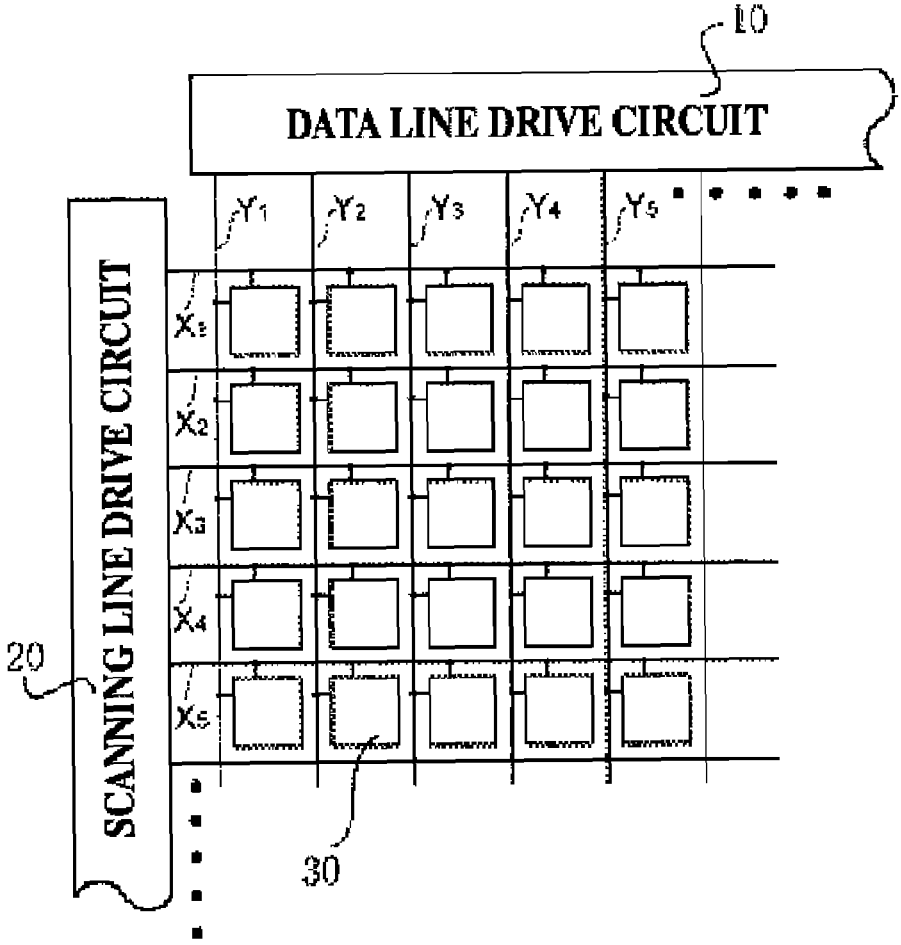
[Fig. 2]
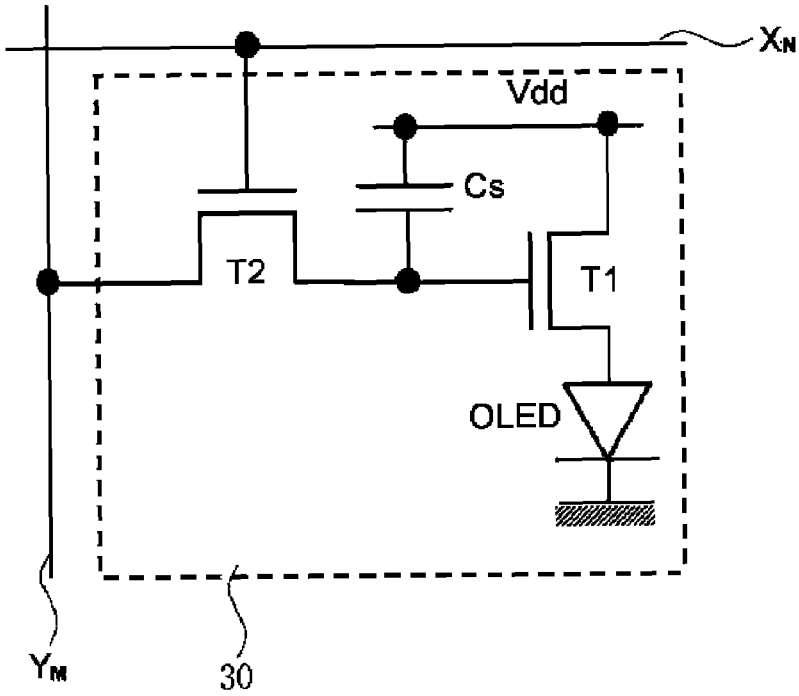

[Fig. 3]
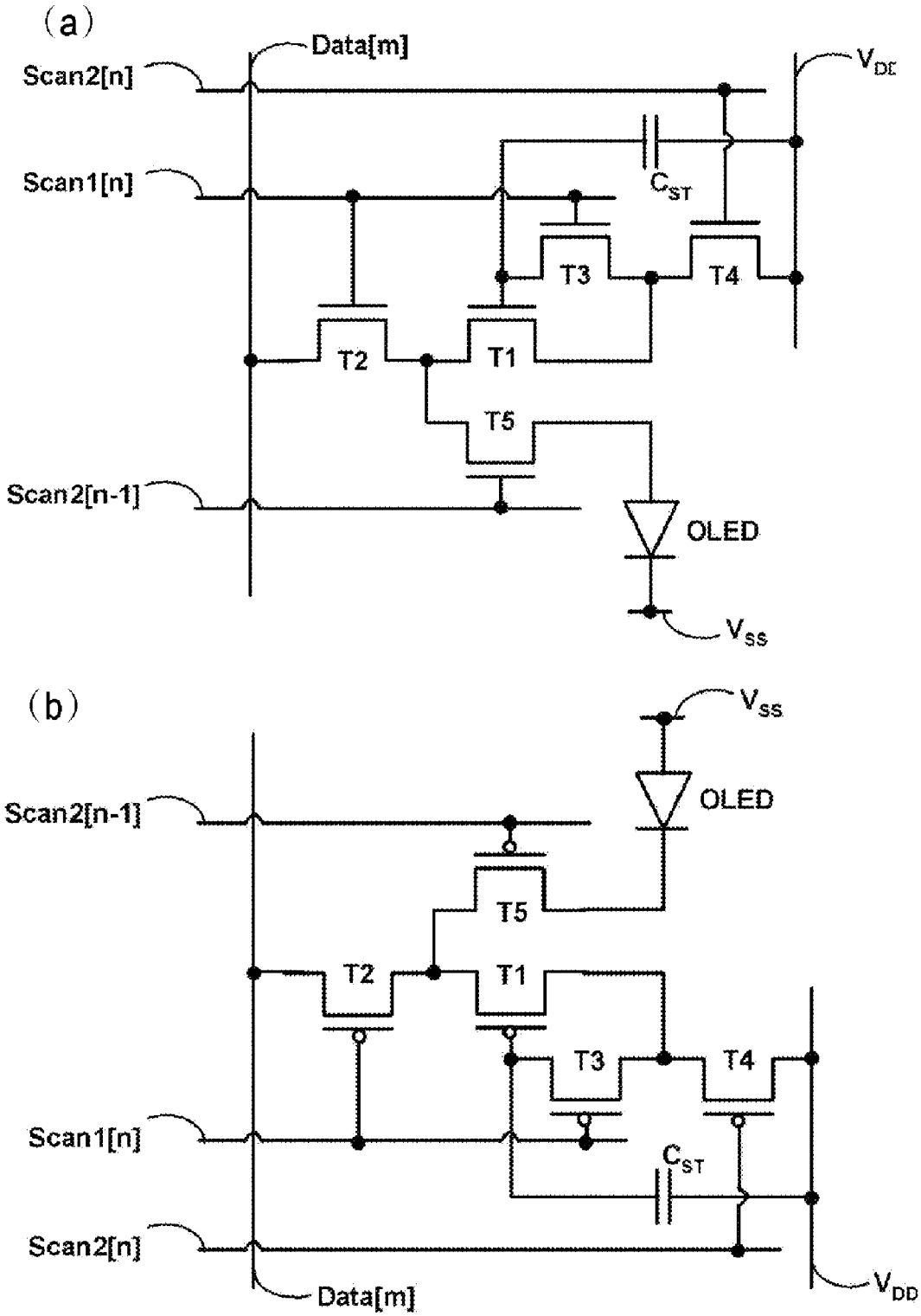

[Fig. 4]
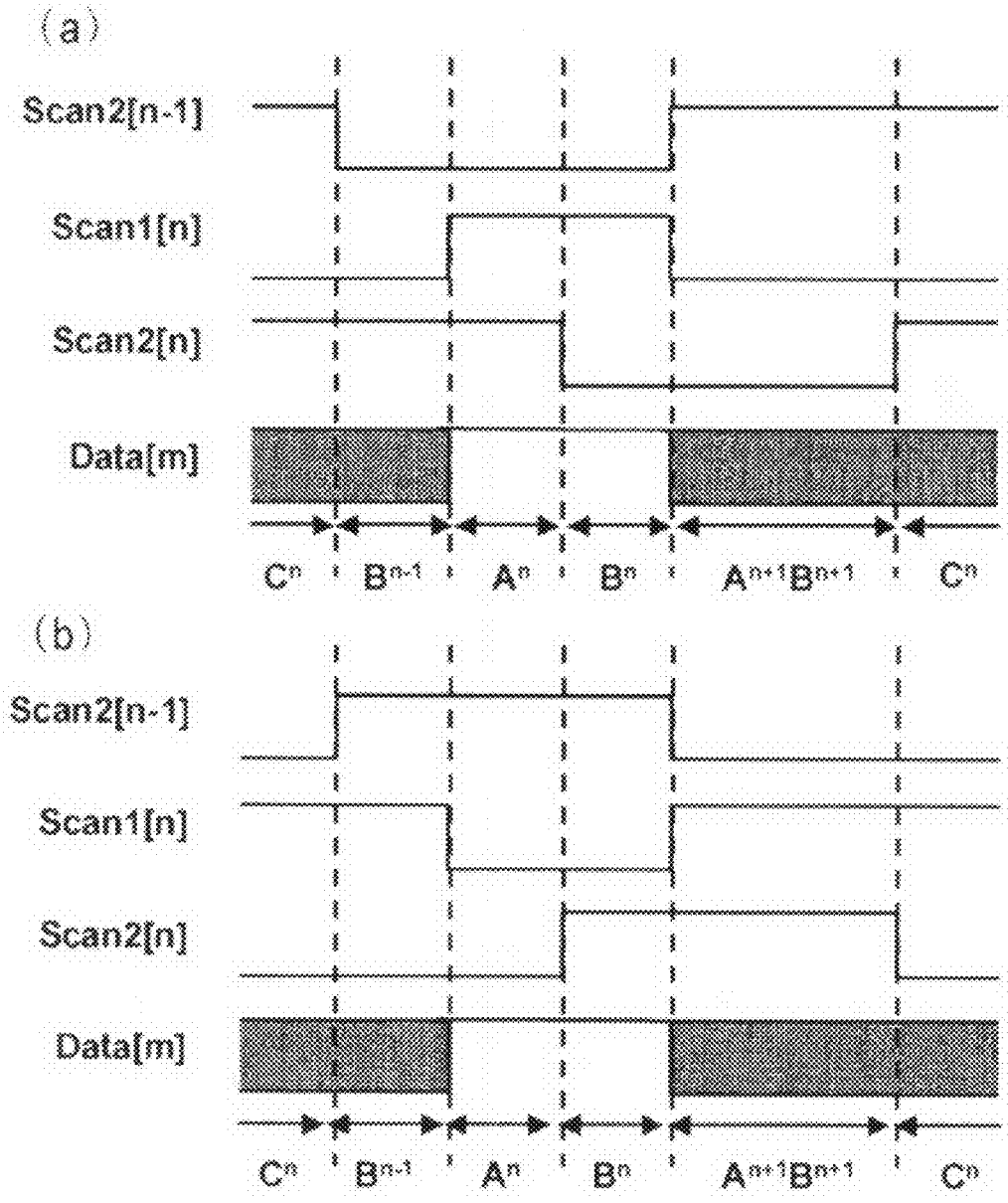

[Fig. 5]
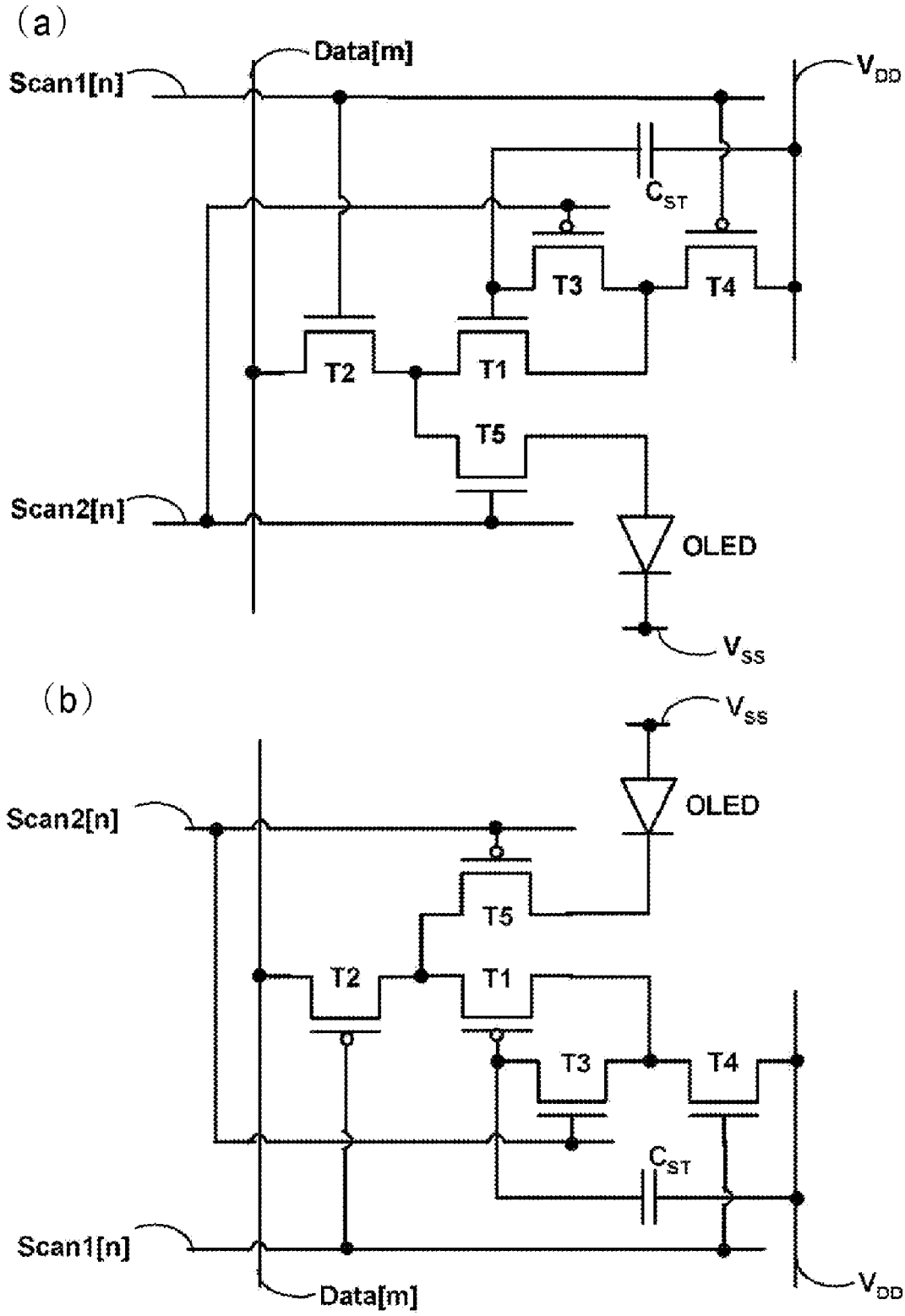

[Fig. 6]
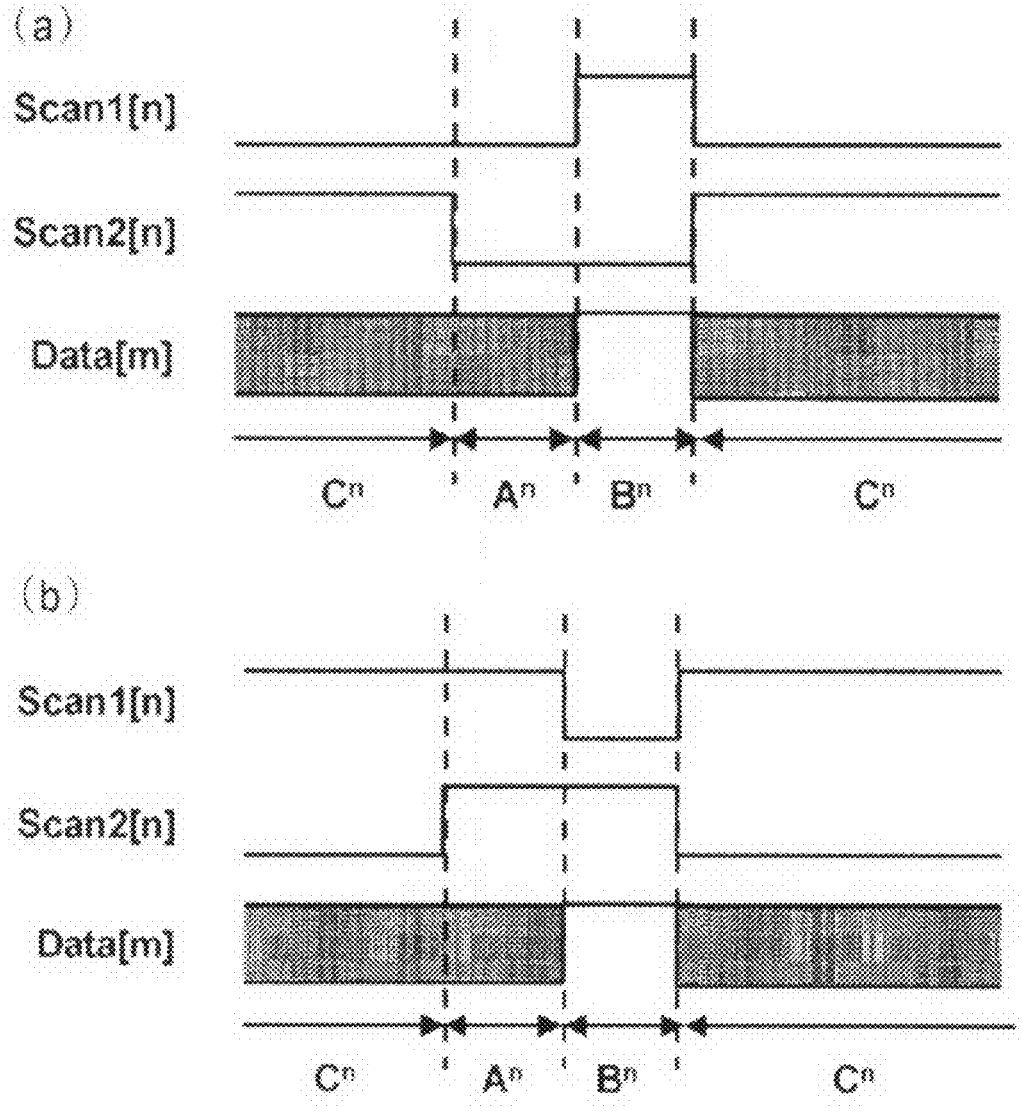

[Fig. 7]
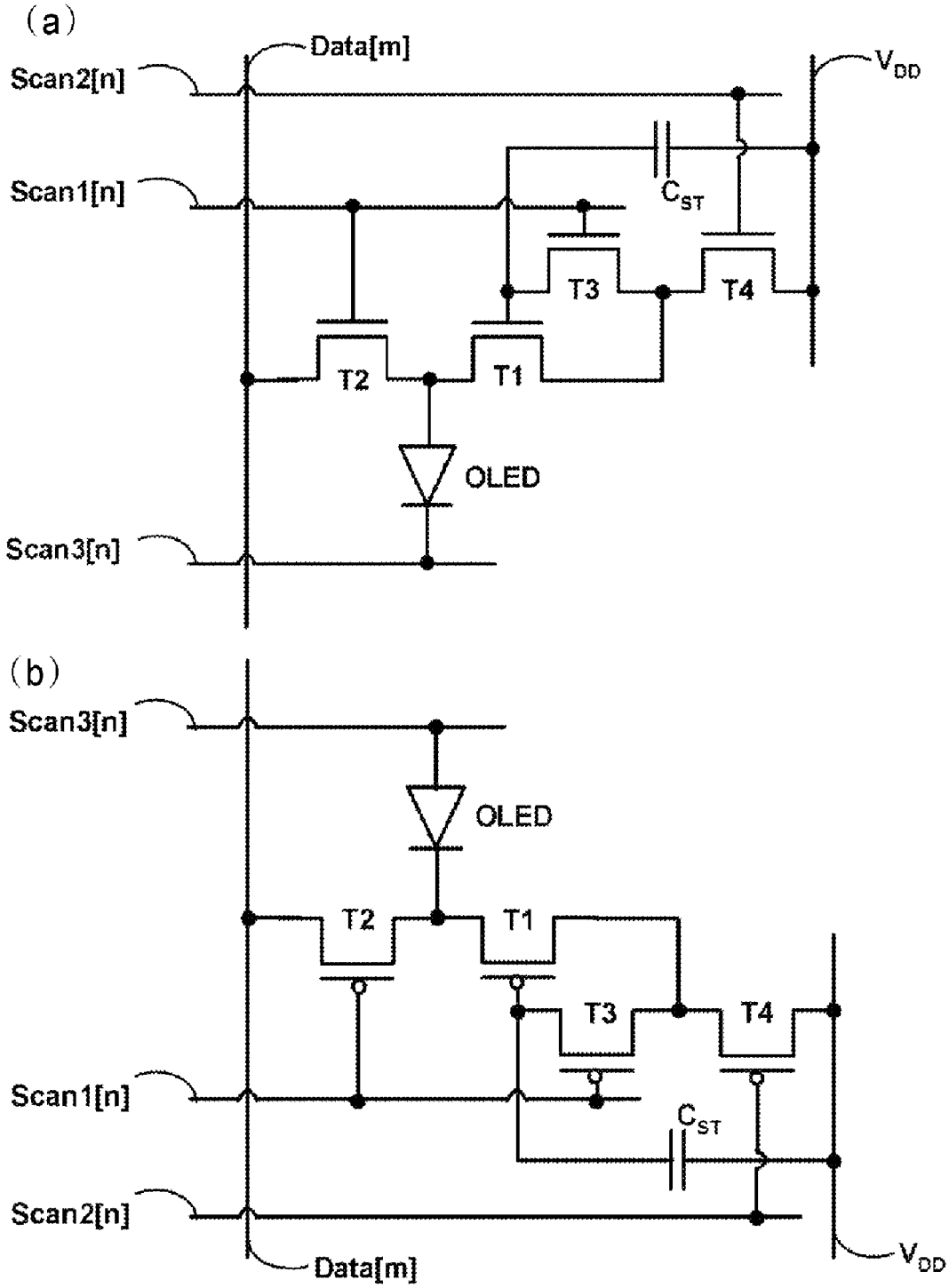

[Fig. 8]
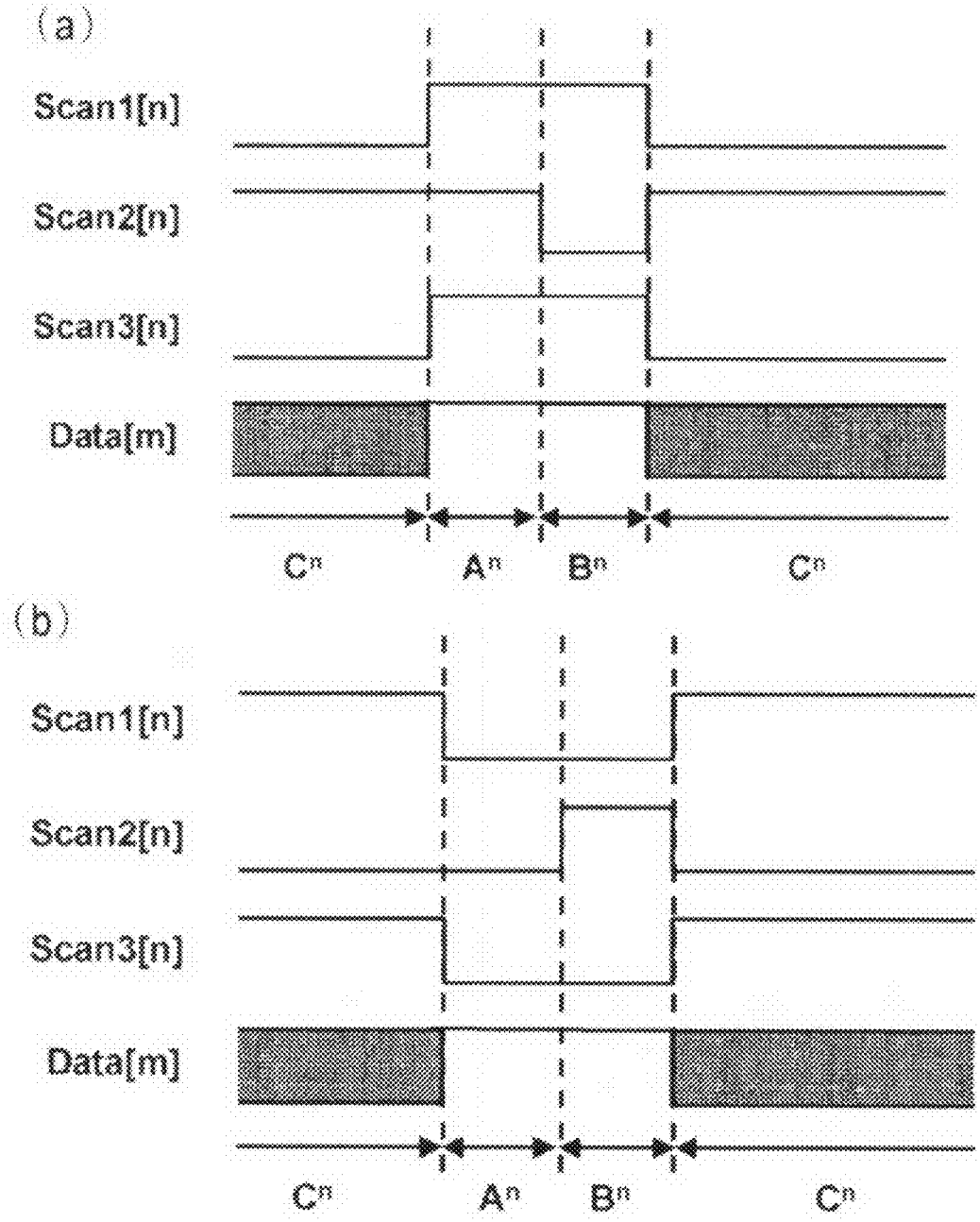

[Fig. 9]
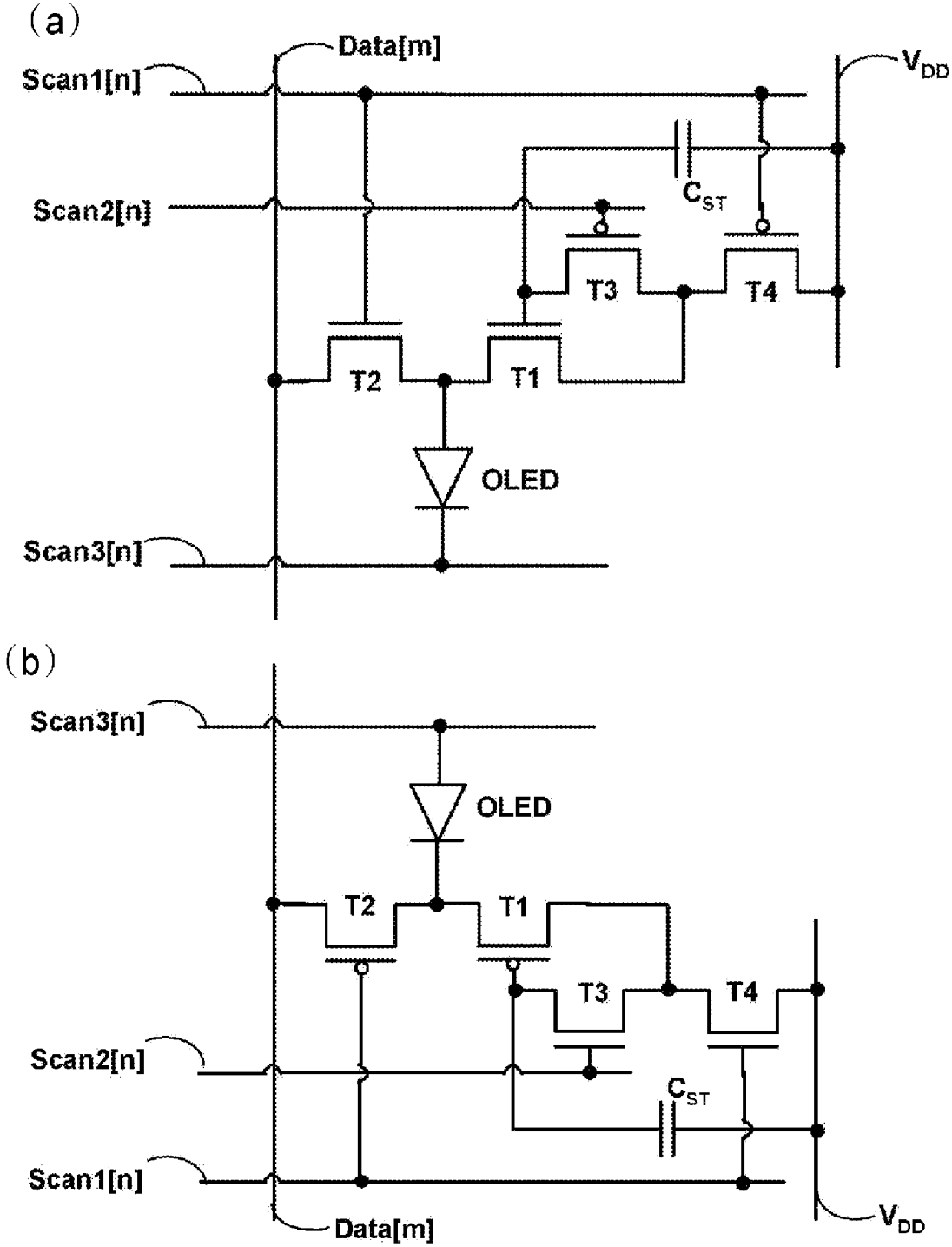

[Fig. 10]
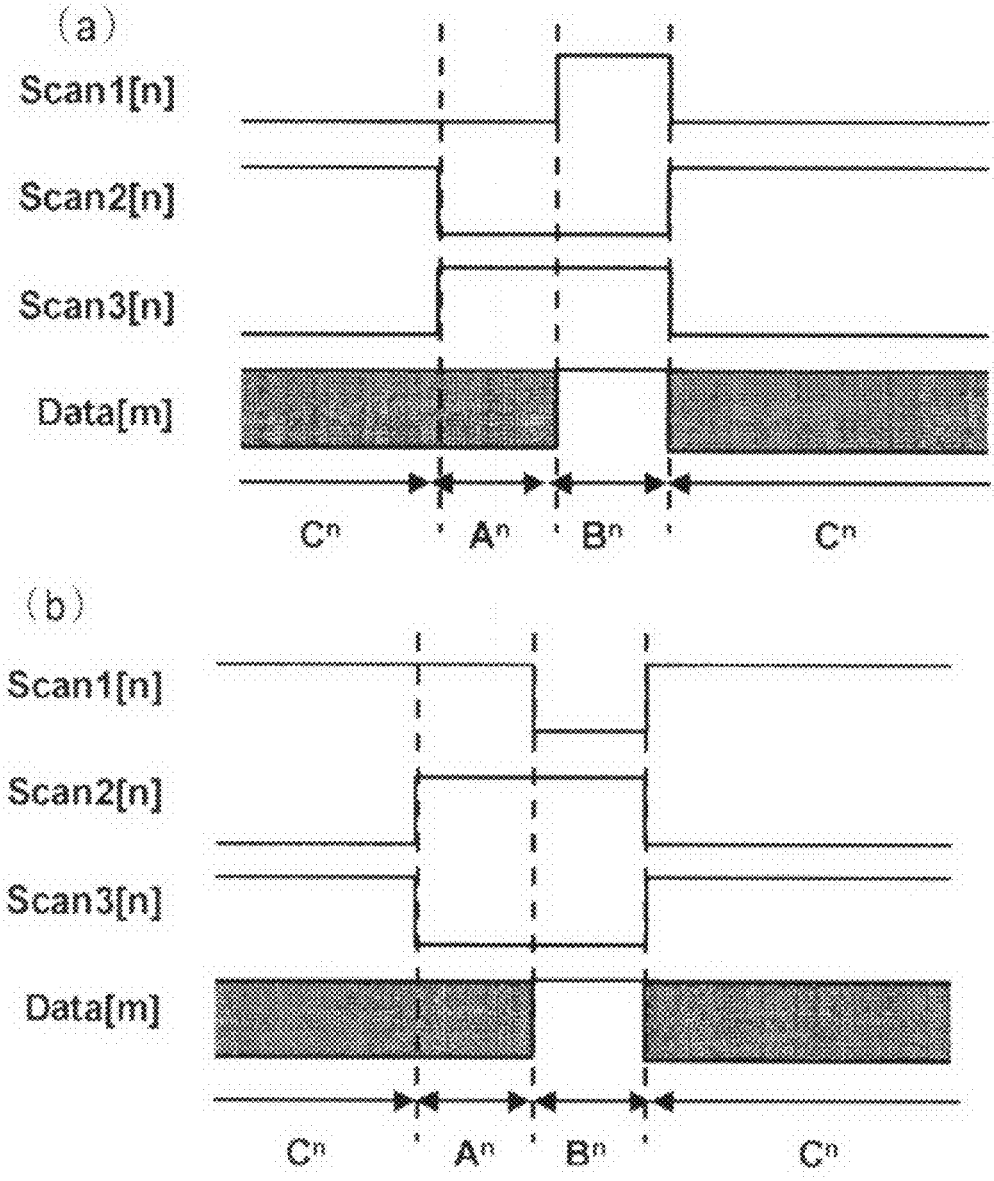

CIRCUIT AND METHOD FOR DRIVING ORGANIC LIGHT EMITTING DIODE

TECHNICAL FIELD

The present invention relates to a drive circuit for organic light emitting diodes (OLEDs), and a method for driving OLEDs, using the drive circuit, and more particularly to a drive circuit for OLEDs, which uses TFTs as active elements thereof, and a method for driving OLEDs, using the drive circuit.

BACKGROUND ART

Displays using OLEDs are self-luminous displays, in which a fluorescent organic compound is excited to emit light. Such a self-luminous display has advantages in that it can be driven at a low voltage, while having a thin structure. Since this display also has features such as a wide viewing angle and a rapid response speed, it is being highlighted as a next-generation display candidate capable of solving problems incurred in liquid crystal displays (LCDs). Also, this display is being highlighted as a next-generation flat panel display in that it can have a picture quality equivalent to or better than that of thin film transistor (TFT) LCDs in the case of a medium or smaller size, and it is advantageous in terms of price competitiveness because the manufacturing process thereof is simple.

Hereinafter, the operation principle of the display, which uses OLEDs, will be described in brief. As electric power is supplied into an OLED, current flows through the OLED in accordance with movement of electrons. Specifically, electrons (positive charge) at the side of an anode are moved to a light emitting layer in accordance with assistance of an electron transporting layer. On the other hand, holes (electron deficiencies, negative charge) at the side of a cathode are moved to the light emitting layer in accordance with an assistance of a hole transporting layer. As a result, the electrons and holes are recombined in the light emitting layer, which is made of an organic material, thereby producing excitons having high energy. When the energy of excitons is reduced to a base level, light is emitted. The color of the emitted light is determined, depending on the kind of the organic material forming the light emitting layer. Using organic materials capable of emitting red (R), green (G), and blue (B), respectively, it is possible to realize a full-color display. Thus, the above-mentioned display uses self-luminous organic materials, as compared to LCDs, which simply use a function of switching on/off pixels.

OLED display devices, which are used as thin film display devices, have been advanced from a passive matrix pixel arrangement to an active matrix pixel arrangement, as in commercially available LCDs, which are currently widely used. Although passive matrix type OLED display devices have advantages of a simple arrangement and application of correct data to each pixel, they have a drawback in that it is difficult to implement large-size and high definition displays. For this reason, development of active matrix type OLED display devices is actively underway.

Now, a drive circuit of a conventional active matrix type OLED display device will be described with reference to FIG. 1.

FIG. 1 is a schematic view illustrating an OLED drive circuit, which includes general active matrix type pixel circuits.

Referring to FIG. 1, the OLED drive circuit includes a matrix arrangement of a plurality of scanning lines $X_1$, $X_2$, $X_3$, . . . for selecting or deselecting pixels 30 at intervals of a predetermined scanning cycle (for example, a frame period according to the NTSC Standard), and a plurality of data lines $Y_1, Y_2, Y_3$, . . . for supplying luminance information to drive the pixels 30. The pixels 30 are formed at respective intersections of the matrix arrangement. Each pixel is constituted by a pixel circuit.

The scanning lines $X_1$, $X_2$, $X_3$, . . . are connected to a scanning line drive circuit 20, whereas the data lines $Y_1$, $Y_2$, $Y_3$, . . . are connected to a data line drive circuit 10. A desired image can be displayed by sequentially selecting the scanning lines $X_1$, $X_2$, $X_3$, . . . by the scanning line drive circuit 20, applying a voltage corresponding to the luminance information applied to an associated one of the data lines $Y_1$, $Y_2$, $Y_3$, . . . to each pixel of the selected scanning line through the associated data line, and repeating the voltage application for all pixels of the sequentially selected scanning lines. In accordance with a drive circuit of a passive matrix type OLED display device, the light emitting element of each pixel emits light only at a moment when the light emitting element is selected. On the other hand, in the drive circuit of an active matrix type OLED display device, the light emitting element of each pixel continuously emits light even after the completion of the application of luminance information thereto. Accordingly, the active matrix type OLED display device is advantageous in terms of high definition display in a large size screen because the light the drive current level of the light emitting element thereof is lowered, as compared to that of the passive matrix type OLED display device.

The operation of the drive circuit in the OLED display device including a plurality of pixels 30 will now be described in detail. In accordance with the drive operation of the drive current, the scanning line drive circuit 20 selects one scanning line $X_N$ from the scanning lines $X_1, X_2, X_3, \ldots$, and transmits a select signal to the selected scanning line $X_N$, and the data line drive circuit 10 transmits data, that is, luminance information, to the pixels of the selected scanning line $X_N$ through the data lines $Y_1$, $Y_2$, $Y_3$, . . . , respectively. Thereafter, the scanning line drive circuit 20 transmits a deselect signal to the selected scanning line $X_N$. In this state, the scanning line drive circuit 20 selects the next scanning line $X_{N+1}$, and then transmits a select signal to the selected next scanning line $X_{N+1}$. As the select and deselect signals are sequentially transmitted to the scanning lines, transmission of data can be repeatedly and sequentially achieved. Accordingly, the drive circuit of the OLED display device can display a desired image.

FIG. 2 is a circuit diagram illustrating a pixel circuit included in the conventional drive circuit of the active matrix type OLED display device.

Referring to FIG. 2, the pixel circuit, which is adapted to drive one pixel 30, includes an OLED, first and second NMOS transistors T1 and T2, and a capacitor Cs. The first transistor T1 performs current control. The transistor T1 is connected at a source thereof to the OLED, while being connected at a drain thereof to a positive voltage source Vdd. The transistor T2 is connected at a gate thereof to the scanning line $X_N$ associated therewith, while being connected at a drain thereof to the data line $Y_M$ associated therewith. The source of the transistor T2 is connected to both the gate of the transistor T1 and the capacitor Cs. The OLED is connected to a cathode thereof to a ground voltage source. Accordingly, the voltage of the data line $Y_M$ is applied to the gate of the transistor T1 through the transistor T2, so as to control current flowing through the OLED.

When the transistor T2 receives, at the gate thereof, a select signal from the scanning line $X_N$, it is turned on. At this time, the voltage corresponding to the luminance information applied to the data line $Y_M$ from the data line drive circuit 10 is applied to the gate of the transistor T1 via the transistor T2. The luminance information voltage is also stored in the capacitor Cs. As a result, the gate voltage of the transistor T1 is stably maintained by the capacitor Cs even for one frame period, in which the transistor T2 is maintained in an OFF state thereof by a deselect signal applied to the scanning line XN. Accordingly, the current flowing in the OLED via the transistor T1 is constantly maintained.

Since the current flowing through the OLED corresponds to the current flowing from the drain of the transistor T1 to the source thereof in the above-mentioned conventional pixel circuit, this current can be controlled by the gate voltage of the transistor T1. However, this current may be different from a desired current due to a degradation in the characteristics of the transistor T1 caused by a non-uniformity of the characteristics of the transistor T1 or a prolonged operation of the transistor T1.

TFTs, which are used in display devices, are positive elements easily meeting the requirement of high definition and large-size display. However, such TFTs may have a threshold voltage deviation of several hundred mV even though they are formed on the same substrate. In some cases, there may be a threshold voltage deviation of 1V or more. In such a case, there may be a problem in that, although the same signal voltage Vw is inputted to TFTs of pixels, the amounts of current flowing through respective OLEDs of the pixels may be different from each other greatly beyond an allowable range when respective TFTs of the pixels have different threshold voltages. In this case, it is impossible to expect a good display quality. Such a threshold voltage difference is inevitably present between different manufacturing routes or different products, even though it may not be large. For this reason, it is necessary to determine the data line potential causing a desired drive current to flow through the OLED, based on parameters, which may be determined to have different values for different products. However, this method is impractical for mass production of displays.

Furthermore, the TFTs may involve a great variation in initial threshold voltage value due to a degradation in characteristics caused by ambient temperature or prolonged use. In this case, the display quality or brightness may severely vary during use of the display device. For this reason, the life of the display device may be abruptly reduced. However, it is very difficult to provide a measure capable of solving this problem.

DISCLOSURE OF INVENTION

Technical Problem

The present invention has been made in view of the above-mentioned problems, and an object of the invention is to provide a drive circuit for an OLED, which is capable of applying a desired drive current to the OLED without being influenced by a non-uniformity of the threshold voltage of a transistor used in an active matrix type arrangement, and an OLED driving method using the drive circuit, which is capable of displaying a high-quality image.

Technical Solution

In accordance with one aspect, the present invention provides a drive circuit for organic light emitting diodes comprising a scanning line drive circuit for sequentially applying a select or deselect signal to a plurality of scanning lines, a data line drive circuit for applying, to a plurality of data lines, voltages corresponding to respective pieces of image information associated with the data lines, and pixel circuits arranged at intersections between the scanning lines and the data lines. Each pixel circuit comprises a first transistor for receiving a data voltage transmitted via an associated one of the data line, and outputting a drive current to an organic light emitting diode (OLED), a second transistor for transmitting the data voltage to the first transistor in accordance with the scanning line select signal, a third transistor for connecting the gate and drain of the first transistor, a capacitor for storing a gate voltage of the first transistor, and a fourth transistor connected to the drain of the first transistor. The OLED may be connected to the source of the first transistor by a fifth transistor. Alternatively, the OLED may be directly connected to the source of the first transistor without using the fifth transistor. Thus, the drive circuit for OLEDs mainly has a pixel circuit configuration including five transistors and one capacitor, or a pixel circuit configuration including four transistors and one capacitor.

BRIEF DESCRIPTION OF THE DRAWINGS

The above object, and other features and advantages of the present invention will become more apparent after reading the following detailed description when taken in conjunction with the drawings, in which:

FIG. 1 is a schematic view illustrating a conventional OLED drive circuit, which includes conventional active matrix type pixel circuits;

FIG. 2 is a circuit diagram illustrating a pixel circuit included in the conventional active matrix type OLED drive circuit;

FIGS. 3*a* and 3*b* are circuit diagrams each illustrating a pixel circuit included in a drive circuit for driving OLEDs in accordance with a first embodiment of the present invention;

FIGS. 4*a* and 4*b* are waveform diagrams for explaining operations of pixel circuits illustrated in FIGS. 3*a* and 3*b*, respectively;

FIGS. 5*a* and 5*b* are circuit diagrams each illustrating a pixel circuit included in a drive circuit for driving OLEDs in accordance with a second embodiment of the present invention;

FIGS. 6*a* and 6*b* are waveform diagrams for explaining operations of pixel circuits illustrated in FIGS. 3*a* and 3*b*, respectively;

FIGS. 7*a* and 7*b* are circuit diagrams each illustrating a pixel circuit included in a drive circuit for driving OLEDs in accordance with a third embodiment of the present invention;

FIGS. 8*a* and 8*b* are waveform diagrams for explaining operations of pixel circuits illustrated in FIGS. 7*a* and 7*b*, respectively;

FIGS. 9*a* and 9*b* are circuit diagrams each illustrating a pixel circuit included in a drive circuit for driving OLEDs in accordance with a second embodiment of the present invention; and FIGS. 10*a* and 10*b* are waveform diagrams for explaining operations of pixel circuits illustrated in FIGS. 9*a* and 9*b*, respectively.

MODE FOR THE INVENTION

Best Mode for Carrying Out the Invention

Hereinafter, preferred embodiments of the present invention will be described with reference to the annexed drawings.

Embodiment 1

FIGS. 3*a* and 3*b* are circuit diagrams each illustrating a pixel circuit included in a drive circuit for driving OLEDs in accordance with a first embodiment of the present invention. The illustrated pixel circuit corresponds to a pixel circuit arranged on an n-th row and an m-th column in a display device, in which a plurality of pixel circuits are arranged in a matrix. The pixel circuit includes five transistors, and one capacitor.

FIG. 3*a* is a circuit diagram illustrating the case in which the transistors of the pixel circuit adapted to drive an OLED are of an NMOS type. FIG. 3*b* is a circuit diagram illustrating the case in which the transistors of the pixel circuit are of a PMOS type.

Referring to FIGS. 3*a* and 3*b*, a first scanning line Scan1[n] is connected to respective gates of transistors T2 and T3. The transistor T3 connects the gate and drain of a transistor T1, which is adapted to control current flowing through an OLED. A voltage, which corresponds to image information applied to a data line data[m], is transmitted to the source of the transistor T1 via the transistor T2. A second scanning line Scan2[n] is connected to the gate of a transistor T4. The transistor T4 connects the drain of the transistor T1 to a supply voltage $V_{DD}$. A capacitor $C_{ST}$ is connected, at one end thereof, to the gate of the transistor T1. The capacitor $C_{ST}$ is adapted to maintain the gate voltage of the transistor T1 for one frame period. The other end of the capacitor $C_{ST}$ is connected to the supply voltage $V_{DD}$. A second scanning line Scan2[n−1] on a previous row, that is, an n−1-th row, is connected to the gate of a transistor T5. The transistor T5 connects the source of the transistor T1 and the OLED.

Referring to FIG. 3*a*, the OLED is connected, at an anode thereof, to the transistor T5, while being connected, at a cathode thereof, to a voltage $V_{SS}$. In this case, the supply voltage $V_{DD}$ has a voltage level higher than the voltage $V_{SS}$. On the other hand, in the case of FIG. 3*b*, the OLED is connected, at the cathode, to the transistor T5, while being connected, at the anode, to the voltage $V_{SS}$. In this case, the voltage $V_{SS}$ has a voltage level higher than the supply voltage $V_{DD}$.

FIG. 4*a* is a waveform diagram illustrating signals for driving the pixel circuit according to FIG. 3*a*. FIG. 4*b* is a waveform diagram illustrating signals for driving the pixel circuit according to FIG. 3*b*.

Referring to FIGS. 4*a* and 4*b*, the pixel circuit according to the first embodiment of the present invention has an operation period, which is divided into an initialization period $A^n$, a data input period B-$^n$, and a light emission period $C^n$. Here, "$B^{n-1}$" represents the data input period of the previous row.

In the initialization period $A^n$, select signals on the scanning lines Scan1[n] and Scan2[n] are applied to respective gates of the transistors T2, T3, and T4, so that the transistors T2, T3, and T4 are turned on. Simultaneously, a deselect signal on the scanning line Scan2[n−1] is applied to the gate of the transistor T5, so that the transistor T5 is turned off. In the OFF state of the transistor T5, no current is supplied to the OLED, so that the OLD does not emit light. Also, a data voltage is applied to the data line Data[m]. Since the transistor T2 is maintained in an ON state thereof by the select signal on the scanning line Scan1[n], the data voltage is applied to the source of the transistor T1 via the transistor T2. Meanwhile, the supply voltage $V_{DD}$ is applied to the gate of the transistor T1 via a path defined by the transistors T4 and T3 turned on by respective select signals on the scanning lines Scan2[n] and Scan1[n]. As a result, the gate of the transistor T1 is initialized to a voltage level corresponding to the level of the supply voltage $V_{DD}$. Also, the capacitor $C_{ST}$, which is connected at one end thereof to the gate of the transistor, stores the potential of the supply voltage $V_{DD}$.

In the data input period $B^n$, the select signal on the scanning line Scan1[n] is applied to respective gates of the transistors T2 and T3, so that the transistors T2 and T3 are turned on. Simultaneously, deselect signals on the scanning line Scan2[n] and Scan2[n−1] are applied to respective gates of the transistors T4 and T5, so that the transistors T4 and T5 are turned off. As a result, current flows only through the turned-on transistors T2 and T3. In this state, the transistor T1 is turned on because the supply voltage stored in the capacitor $C_{ST}$ is applied to the gate of the transistor T1. Also, the data voltage applied to the data line Data[m] is transmitted to the source of the transistor T1 via the turned-on transistor T2. Charges, which are present at the gate of the transistor T1 to initialize the gate of the transistor T1 in the initialization period $A^n$, are stored or released while flowing along a path connected between the capacitor $C_{ST}$ and the data line Data[m] via the transistors T3, T1, and T2. The charging or discharging operation is continued until the transistor T1 is turned off. Consequently, a voltage difference is generated between the gate and source of the transistor T1. This voltage difference is a threshold voltage of the transistor T1. Therefore, the voltage, which is applied to the gate of the transistor T1 at a moment when the transistor T1 is turned off, corresponds to a voltage obtained by summing the data voltage and the threshold voltage. The voltage sum, which is applied to the gate of the transistor T1 at the moment when the transistor T1 is turned off, is stored in the capacitor $C_{ST}$ connected at one end thereof to the gate of the transistor T1. "$A^{n+1}$" and "$B^{n+1}$" represent the initialization period and data input period of the next row, respectively.

Finally, in the light emission period $C^n$, a deselect signal is applied to the scanning line Scan[n], so that the transistors T2 and T3 are turned off. Simultaneously, the transistors T4 and T5 are turned on by select signals on the scanning lines Scan2[n] and Scan2[n−1], respectively. As a result, the transistor T1 drives the OLED for one frame by flowing, through the OLED, current compensated for the threshold voltage by the voltage stored in the capacitor $C_{ST}$ in the data input period $B^n$.

Embodiment 2

FIGS. 5*a* and 5*b* are circuit diagrams each illustrating a pixel circuit included in a drive circuit for driving OLEDs in accordance with a second embodiment of the present invention. The illustrated pixel circuit corresponds to a pixel circuit arranged on an n-th row and an m-th column in a display device, in which a plurality of pixel circuits are arranged in a matrix. The pixel circuit includes five transistors, and one capacitor.

FIG. 5*a* is a circuit diagram illustrating the case in which three NMOS transistors T1, T2 and T5 and two PMOS transistors T3 and T4 are used to drive an OLED. FIG. 5*b* is a circuit diagram illustrating the case in which three PMOS transistors T1, T2 and T5 and two NMOS transistors T3 and T4 are used.

Referring to FIGS. 5*a* and 5*b*, a first scanning line Scan1[n] is connected to respective gates of the transistors T2 and T4. A second scanning line Scan2[n] is connected to respective gates of the transistors T3 and T5. The transistor T3 connects the gate and drain of the transistor T1, which controls current flowing through the OLED. A voltage, which corresponds to image information applied to a data line data[m], is transmitted to the source of the transistor T1 via the transistor T2. The transistor T4 connects the drain of the transistor T1 to a supply voltage $V_{DD}$. A capacitor $C_{ST}$ is connected, at one end thereof, to the gate of the transistor T1. The capacitor $C_{ST}$ is adapted to maintain the gate voltage of the transistor T1 for one frame period. The other end of the capacitor $C_{ST}$ is connected to the supply voltage $V_{DD}$. The transistor T5 connects the source of the transistor T1 and the OLED.

Referring to FIG. 5*a*, the OLED is connected, at an anode thereof, to the transistor T5, while being connected, at a cathode thereof, to a voltage $V_{SS}$. In this case, the supply voltage $V_{DD}$ has a voltage level higher than the voltage $V_{SS}$. On the other hand, in the case of FIG. 5*b*, the OLED is connected, at the cathode, to the transistor T5, while being connected, at the anode, to the voltage $V_{SS}$. In this case, the voltage $V_{SS}$ has a voltage level higher than the supply voltage $V_{DD}$.

FIG. 6*a* is a waveform diagram illustrating signals for driving the pixel circuit according to FIG. 5*a*. FIG. 6*b* is a waveform diagram illustrating signals for driving the pixel circuit according to FIG. 5*b*.

Referring to FIGS. 6*a* and 6*b*, the pixel circuit according to the second embodiment of the present invention has an operation period, which is divided into an initialization period $A^n$, a data input period $B\text{-}^n$, and a light emission period $C^n$.

In the initialization period $A^n$, the transistor T2 is turned off by a signal on the scanning line Scan1[n]. By the same signal, the transistor T4 is turned on. Simultaneously, the transistor T3 is turned on by a signal on the scanning line Scan2[n]. By the signal on the scanning line Scan2[n], the transistor T5 is turned off. As a result, the gate of the transistor T1 is initialized to a voltage level corresponding to the level of the supply voltage $V_{DD}$, which is supplied along a path defined via the transistor T4 and transistor T3. The potential of the supply voltage V is stored in the capacitor $C_{ST}$.

In the data input period $B^n$, the transistor T2 is turned on by the signal on the scanning line Scan1[n]. By the same signal, the transistor T4 is turned off. Simultaneously, the transistor T3 is turned on by the signal on the scanning line Scan2[n]. By the signal on the scanning line Scan2[n], the transistor T5 is turned off. As a result, the data voltage applied to the data line Data[m] is transmitted to the source of the transistor T1 via the turned-on transistor T2. Charges, which are present at the gate of the transistor T1 to initialize the gate of the transistor T1 in the initialization period $A^n$, are stored or released while flowing along a path connected between the capacitor $C_{ST}$ and the data line Data[m] via the transistors T3, T1, and T2. The charging or discharging operation is continued until the transistor T1 is turned off. Consequently, a voltage difference is generated between the gate and source of the transistor T1. This voltage difference is a threshold voltage of the transistor T1. Therefore, a voltage, which is obtained by adding the threshold voltage to the data voltage, is applied to the gate of the transistor T1. Accordingly, the voltage is stored in the capacitor $C_{ST}$.

In the light emission period $C^n$, the transistor T2 is turned off by the signal on the scanning line Scan1[n]. By the same signal, the transistor T4 is turned on. Simultaneously, the transistor T3 is turned off by the signal on the scanning line Scan2[n]. By the signal on the scanning line Scan2[n], the transistor T5 is turned on. As a result, the transistor T1 drives the OLED for one frame by flowing, through the OLED, current compensated for the threshold voltage by the voltage stored in the capacitor $C_{ST}$ in the data input period $B^n$.

Embodiment 3

FIGS. 7*a* and 7*b* are circuit diagrams each illustrating a pixel circuit included in a drive circuit for driving OLEDs in accordance with a third embodiment of the present invention. The illustrated pixel circuit corresponds to a pixel circuit arranged on an n-th row and an m-th column in a display device, in which a plurality of pixel circuits are arranged in a matrix. The pixel circuit includes four transistors, and one capacitor, as compared to the first and second embodiments.

FIG. 7*a* is a circuit diagram illustrating the case in which the transistors of the pixel circuit adapted to drive an OLED are of an NMOS type. FIG. 7*b* is a circuit diagram illustrating the case in which the transistors of the pixel circuit are of a PMOS type.

Referring to FIGS. 7*a* and 7*b*, a first scanning line Scan1[n] is connected to respective gates of the transistors T2 and T3. The transistor T3 connects the gate and drain of the transistor T1, which controls current flowing through the OLED. A voltage, which corresponds to image information applied to a data line data[m], is transmitted to the source of the transistor T1 via the transistor T2. A second scanning line Scan2[n] is connected to the gate of a transistor T4. The transistor T4 connects the drain of the transistor T1 to a supply voltage $V_{DD}$. A capacitor $C_{ST}$ is connected, at one end thereof, to the gate of the transistor T1. The capacitor $C_{ST}$ is adapted to maintain the gate voltage of the transistor T1 for one frame period. The other end of the capacitor $C_{ST}$ is connected to the supply voltage $V_{DD}$.

Referring to FIG. 7*a*, the OLED is connected, at an anode thereof, to the source of the transistor T1, while being connected, at a cathode thereof, to a third scanning line Scan3[n]. On the other hand, in the case of FIG. 7*b*, the OLED is connected, at the cathode, to the source of the transistor T1, while being connected, at the anode, to the third scanning line Scan3[n].

FIG. 8*a* is a waveform diagram illustrating signals for driving the pixel circuit according to FIG. 7*a*. FIG. 8*b* is a waveform diagram illustrating signals for driving the pixel circuit according to FIG. 7*b*.

Referring to FIGS. 8*a* and 8*b*, the pixel circuit according to the third embodiment of the present invention has an operation period, which is divided into an initialization period $A^n$, a data input period $B\text{-}^n$, and a light emission period $C^n$.

In the initialization period $A^n$, the transistors T2, T3 and T4 are turned on by the select signals on the scanning lines Scan1[n] and Scan2[n], respectively. Also, the OLED is turned off by the signal on the scanning line Scan3[n]. A data voltage is applied to the data line Data[m], so that the data voltage is applied to the source of the transistor T1 via the transistor T2. Meanwhile, the supply voltage $V_{DD}$ is applied to the gate of the transistor T1 via a path defined by the transistors T4 and T3. As a result, the gate of the transistor T1 is initialized to the level of the supply voltage $V_{DD}$. The potential of the supply voltage $V_{DD}$ is stored in the capacitor $C_{ST}$.

In the data input period $B^n$, the transistors T2 and T3 are turned on by the signal on the scanning line Scan1[n]. Also, the transistor T4 is turned off by the signal on the scanning line Scan2[n]. The OLED is also turned off by the signal on the scanning line Scan3[n]. In this state, the data voltage applied to the data line Data[m] is transmitted to the source of the transistor T1 via the transistor T2. Charges, which are present at the gate of the transistor T1 to initialize the gate of the transistor T1 in the initialization period $A^n$, are stored or released while flowing along a path connected between the capacitor $C_{ST}$ and the data line Data[m] via the transistors T3, T1, and T2. The charging or discharging operation is continued until the transistor T1 is turned off. Consequently, a voltage difference is generated between the gate and source of the transistor T1. This voltage difference is a threshold voltage of the transistor T1. Therefore, a voltage, which is obtained by adding the threshold voltage to the data voltage, is applied to the gate of the transistor T1. Accordingly, the voltage is stored in the capacitor $C_{ST}$.

In the light emission period C", the transistors T2 and T3 are turned off by the signal on the scanning line Scan1[n]. Simultaneously, the transistor T4 is turned on by the signal on the scanning line Scan2[n]. By the signal on the scanning line Scan2[n], the OLED is turned on. As a result, the transistor T1 drives the OLED for one frame by flowing, through the OLED, current compensated for the threshold voltage by the voltage stored in the capacitor $C_{ST}$ in the data input period B".

Embodiment 4

FIGS. 9*a* and 9*b* are circuit diagrams each illustrating a pixel circuit included in a drive circuit for driving OLEDs in accordance with a fourth embodiment of the present invention. The illustrated pixel circuit corresponds to a pixel circuit arranged on an n-th row and an m-th column in a display device, in which a plurality of pixel circuits are arranged in a matrix. The pixel circuit includes four transistors, and one capacitor.

FIG. 9*a* is a circuit diagram illustrating the case in which two NMOS transistors T1 and T2 and two PMOS transistors T3 and T4 are used to drive an OLED. FIG. 9*b* is a circuit diagram illustrating the case in which two PMOS transistors T1 and T2, and two NMOS transistors T3 and T4 are used.

Referring to FIGS. 9*a* and 9*b*, a first scanning line Scan1[n] is connected to respective gates of the transistors T2 and T4. A voltage, which corresponds to image information applied to a data line data[m], is transmitted to the source of the transistor T1 via the transistor T2. The transistor T1 serves to control current flowing through the OLED. The transistor T4 connects the drain of the transistor T1 to a supply voltage $V_{DD}$. A second scanning line Scan2[n] is connected to the gate of the transistor T3. The transistor T3 connects the gate and drain of the transistor T1. A capacitor $C_{ST}$ is connected, at one end thereof, to the gate of the transistor T1. The capacitor $C_{ST}$ is adapted to maintain the gate voltage of the transistor T1 for one frame period. The other end of the capacitor $C_{ST}$ is connected to the supply voltage $V_{DD}$.

Referring to FIG. 9*a*, the OLED is connected, at an anode thereof, to the source of the transistor T1, while being connected, at a cathode thereof, to a third scanning line Scan3[n]. On the other hand, in the case of FIG. 9*b*, the OLED is connected, at the cathode, to the source of the transistor T1, while being connected, at the anode, to the third scanning line Scan3[n].

FIG. 10*a* is a waveform diagram illustrating signals for driving the pixel circuit according to FIG. 9*a*. FIG. 10*b* is a waveform diagram illustrating signals for driving the pixel circuit according to FIG. 9*b*.

Referring to FIGS. 10*a* and 10*b*, the pixel circuit according to the fourth embodiment of the present invention has an operation period, which is divided into an initialization period A", a data input period B-", and a light emission period C".

In the initialization period A", the transistor T2 is turned off by a signal on the scanning line Scan1[n]. By the same signal, the transistor T4 is turned on. Simultaneously, the transistor T3 is turned on by a signal on the scanning line Scan2[n].

The OLED is also turned off by a signal on the scanning line Scan3[n]. In this state, the gate of the transistor T1 is initialized to a voltage level corresponding to the level of the supply voltage $V_{DD}$, which is supplied along a path defined via the transistor T4 and transistor T3. The potential of the supply voltage $V_{DD}$ is stored in the capacitor $C_{ST}$.

In the data input period B", the transistor T2 is turned on by the signal on the scanning line Scan1[n]. By the same signal, the transistor T4 is turned off. Simultaneously, the transistor T3 is turned on by the signal on the scanning line Scan2[n]. Also, the OLED is turned off by the signal on the scanning line Scan3[n]. As a result, the data voltage applied to the data line Data[m] is transmitted to the source of the transistor T1 via the transistor T2. Charges, which are present at the gate of the transistor T1 to initialize the gate of the transistor T1 in the initialization period A", are stored or released while flowing along a path connected between the capacitor $C_{ST}$ and the data line Data[m] via the transistors T3, T1, and T2. The charging or discharging operation is continued until the transistor T1 is turned off. Consequently, a voltage difference is generated between the gate and source of the transistor T1. This voltage difference is a threshold voltage of the transistor T1. Therefore, a voltage, which is obtained by idling the threshold voltage to the data voltage, is applied to the gate of the transistor T1. Accordingly, the voltage is stored in the capacitor $C_{ST}$.

In the light emission period C", the transistor T2 is turned off by the signal on the scanning line Scan1[n]. By the same signal, the transistor T4 is turned on. Simultaneously, the transistor T3 is turned off by the signal on the scanning line Scan2[n]. Also, the OLED is turned on by the signal on the Scan3[n]. As a result, the transistor T1 drives the OLED for one frame by flowing, through the OLED, current compensated for the threshold voltage by the voltage stored in the capacitor $C_{ST}$ in the data input period B".

As apparent from the above description, the pixel circuit, which is included in the drive circuit for OLEDs in accordance with the present invention, can generate drive current under the condition in which the threshold voltage of the transistor, which is an active element to control the drive current, is compensated for non-uniformity thereof. Accordingly, it is possible to obtain a uniform luminance of the light emitting element.

Where the pixel circuit, which is included in the drive circuit for OLEDs in accordance with the present invention, is applied to an OLED display device, it is possible to compensate for a variation in the threshold voltage of the transistor caused by prolonged use, and thus, to increase the life of the display device.

Where the pixel circuit, which is included in the drive circuit for OLEDs in accordance with the present invention, is applied to the OLED display device, it is possible to achieve a control operation for allowing desired current to flow through the OLED of each pixel, and thus, to provide a high-quality image even in a high-definition display application.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

The invention claimed is:

1. A drive circuit for organic light emitting diodes comprising a scanning line drive circuit for sequentially applying a select or nonselect signal to scanning lines, a data line drive circuit for applying, to data lines, voltages corresponding to respective pieces of image information associated with the data lines, and pixel circuits arranged at intersections between the scanning lines and the data lines, wherein each of the pixel circuits comprises:

an organic light emitting diode (OLED) having two terminals;

a first transistor having a gate, a source, and a drain, the first transistor supplying a current to the OLED in accordance with a voltage applied to the first transistor;

a second transistor having a gate, a source, and a drain, where the gate of the second transistor is connected to a first scanning line, where the source of the second transistor is connected to a data line, where the drain of the second transistor is connected to the source of the first transistor;

a third transistor having a gate, a source, and a drain, where the gate of the third transistor is connected to a second scanning line, where the source of the third transistor is connected to the gate of the first transistor, where the drain of the third transistor is connected to the drain of the first transistor;

a fourth transistor having a gate, a source, and a drain, where the gate of the fourth transistor is connected to a third scanning line, where the source of the fourth transistor is connected to a power line, where the drain of the fourth transistor is connected to the drain of the first transistor;

a fifth transistor having a gate, a source, and a drain, where the gate of the fifth transistor is connected to a fourth scanning line, where the source of the fifth transistor is connected to the source of the first transistor, where the drain of the fifth transistor is connected to one of the terminals of the OLED; and a capacitor having two terminals, where one of the terminals of the capacitor is connected to the gate of the first transistor.

2. The drive circuit according to claim 1, wherein:

all the transistors are NMOS transistors or PMOS transistors;

the first scanning line is identical to the second scanning line; and the fourth scanning line is a third scanning line in a pixel circuit row preceding to a row where the pixel circuit is arranged.

3. The drive circuit according to claim 1, wherein:

the first scanning line is identical to the third scanning line;

the second scanning line is identical to the fourth scanning line; and the first, second and fifth transistors have an N or P channel different from the third and fourth transistors.

4. A drive circuit for organic light emitting diodes comprising a scanning line drive circuit for sequentially applying a select or non-select signal to scanning lines, a data line drive circuit for applying, to data lines, voltages corresponding to respective pieces of image information associated with the data lines, and pixel circuits arranged at intersections between the scanning lines and the data lines, wherein each of the pixel circuits comprises:

a first transistor having a gate, a source, and a drain, the first transistor supplying a current to an organic light emitting diode (OLED) in accordance with a voltage applied to the first transistor;

a second transistor having a gate, a source, and a drain, where the gate of the second transistor is connected to a first scanning line, where the source of the second transistor is connected to a data line, where the drain of the second transistor is connected to the source of the first transistor;

a third transistor having a gate, a source, and a drain, where the gate of the third transistor is connected to a second scanning line, where the source of the third transistor is connected to the gate of the first transistor, where the drain of the third transistor is connected to the drain of the first transistor;

a fourth transistor having a gate, a source, and a drain, where the gate of the fourth transistor is connected to a third scanning line, where the source of the fourth transistor is connected to a power line, where the drain of the fourth transistor is connected to the drain of the first transistor;

a capacitor having two terminals, where one of the terminals of the capacitor is connected to the gate of the first transistor; and the OLED, which has two terminals, where one of the terminals of the OLED is connected to the source of the first transistor, where the other terminal of the OLED is connected to a fourth scanning line.

5. The drive circuit according to claim 4, wherein:

all the transistors is NMOS transistors or PMOS transistors; and the first scanning line is identical to the second scanning line.

6. The drive circuit according to claim 4, wherein:

the first scanning line is identical to the third scanning line; and the first and second transistors have an N or P channel different from the third and fourth transistors.

7. A method for driving an organic light emitting diode (OLED), using the drive circuit for OLEDs according to claim 2, comprising the steps of:

initializing, by the supply voltage, the gate of the first transistor adapted to supply a current to the OLED in accordance with the voltage applied to the gate of the first transistor, and storing the supply voltage in a capacitor, which is connected, at one end thereof, to the gate of the first transistor;

continuously charging or discharging the capacitor to generate a voltage corresponding to a sum of a data voltage inputted by a data line drive circuit and a threshold voltage of the first transistor, as the gate voltage of the first transistor, and storing the voltage sum in the capacitor; and driving the OLED by the voltage sum stored in the capacitor.

8. The method according to claim 7, wherein the step of storing the supply voltage in the capacitor comprises the steps of:

turning on the second through fourth transistors, while turning off the fifth transistor;

applying, by the data line drive circuit, the data voltage to the source of the first transistor; and applying the supply voltage to the gate of the first transistor via the fourth transistor and the third transistor.

9. The method according to claim 7, wherein the step of storing the voltage sum in the capacitor comprises the steps of:

turning on the second and third transistors, while turning off the fourth and fifth transistors; and repeatedly storing or releasing, via the first through third transistors, charges present at the gate of the first transistor to initialize the gate of the first transistor until the first transistor is turned off.

10. A method for driving an organic light emitting diode (OLED), using the drive circuit for OLEDs according to claim 3, comprising the steps of:

initializing, by the supply voltage, the gate of the first transistor adapted to supply a current to the OLED in accordance with the voltage applied to the gate of the first transistor, and storing the supply voltage in a capacitor, which is connected, at one end thereof, to the gate of the first transistor;

continuously charging or discharging the capacitor to generate a voltage corresponding to a sum of a data voltage inputted by a data line drive circuit and a threshold voltage of the first transistor, as the gate voltage of the first transistor, and storing the voltage sum in the capacitor; and driving the OLED by the voltage sum stored in the capacitor.

11. The method according to claim 10, wherein the step of storing the supply voltage in the capacitor comprises the steps of:

turning on the third and fourth transistors, while turning off the second and fifth transistors; and applying the supply voltage to the gate of the first transistor via the fourth transistor and the third transistor.

12. The method according to claim 10, wherein the step of storing the voltage sum in the capacitor comprises the steps of:

turning on the second and third transistors, while turning off the fourth and fifth transistors;

transmitting the data voltage to the source of the first transistor via the second transistor; and repeatedly storing or releasing, via the first through third transistors, charges present at the gate of the first transistor to initialize the gate of the first transistor until the first transistor is turned off.

13. A method for driving an organic light emitting diode (OLED), using the drive circuit for OLEDs according to claim 5, comprising the steps of:

initializing, by the supply voltage, the gate of the first transistor adapted to supply a current to the OLED in accordance with the voltage applied to the gate of the first transistor, and storing the supply voltage in a capacitor, which is connected, at one end thereof, to the gate of the first transistor;

continuously charging or discharging the capacitor to generate a voltage corresponding to a sum of a data voltage inputted by a data line drive circuit and a threshold voltage of the first transistor, as the gate voltage of the first transistor, and storing the voltage sum in the capacitor; and driving the OLED by the voltage sum stored in the capacitor.

14. The method according to claim 13, wherein the step of storing the supply voltage in the capacitor comprises the steps of:

turning on the second through fourth transistors, while turning off the OLED;

applying, by the data line drive circuit, the data voltage to the source of the first transistor; and applying the supply voltage to the gate of the first transistor via the fourth transistor and the third transistor.

15. The method according to claim 13, wherein the step of storing the voltage sum in the capacitor comprises the steps of:

turning on the second and third transistors, while turning off the fourth transistor and the OLED; and repeatedly storing or releasing, via the first through third transistors, charges present at the gate of the first transistor to initialize the gate of the first transistor until the first transistor is turned off.

16. A method for driving an organic light emitting diode (OLED), using the drive circuit for OLEDs according to claim 6, comprising the steps of:

initializing, by the supply voltage, the gate of the first transistor adapted to supply a current to the OLED in accordance with the voltage applied to the gate of the first transistor, and storing the supply voltage in a capacitor, which is connected, at one end thereof, to the gate of the first transistor;

continuously charging or discharging the capacitor to generate a voltage corresponding to a sum of a data voltage inputted by a data line drive circuit and a threshold voltage of the first transistor, as the gate voltage of the first transistor, and storing the voltage sum in the capacitor; and driving the OLED by the voltage sum stored in the capacitor.

17. The method according to claim 16, wherein the step of storing the supply voltage in the capacitor comprises the steps of:

turning on the third and fourth transistors, while turning off the second transistor and the OLED; and applying the supply voltage to the gate of the first transistor via the fourth transistor and the third transistor.

18. The method according to claim 16, wherein the step of storing the voltage sum in the capacitor comprises the steps of:

turning on the second and third transistors, while turning off the fourth transistor and the OLED;

transmitting the data voltage to the source of the first transistor via the second transistor; and repeatedly storing or releasing, via the first through third transistors, charges present at the gate of the first transistor to initialize the gate of the first transistor until the first transistor is turned off.

* * * * *